US009538294B2

(12) United States Patent
Froehlich

(10) Patent No.: US 9,538,294 B2
(45) Date of Patent: Jan. 3, 2017

(54) METHOD AND DEVICE FOR ANALYZING HEARING AID SETTINGS

(71) Applicant: SIVANTOS PTE. LTD., Singapore (SG)

(72) Inventor: Matthias Froehlich, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 44 days.

(21) Appl. No.: 14/598,412

(22) Filed: Jan. 16, 2015

(65) Prior Publication Data

US 2015/0201285 A1 Jul. 16, 2015

(30) Foreign Application Priority Data

Jan. 16, 2014 (DE) ..... 10 2014 200 677

(51) Int. Cl.
*H04R 29/00* (2006.01)
*H04R 25/00* (2006.01)

(52) U.S. Cl.
CPC ..... *H04R 25/30* (2013.01); *H04R 25/70* (2013.01)

(58) Field of Classification Search
None
See application file for complete search history.

(56) References Cited

U.S. PATENT DOCUMENTS

| | | | | |
|---|---|---|---|---|
| 7,885,416 | B2 | 2/2011 | Chalupper et al. | |
| 8,180,079 | B2 | 5/2012 | Bindner et al. | |
| 8,249,262 | B2 | 8/2012 | Chua et al. | |
| 2014/0086417 | A1* | 3/2014 | Hansen | H04R 25/43 381/23.1 |

FOREIGN PATENT DOCUMENTS

| | | | |
|---|---|---|---|
| DE | 102007039185 | A1 | 2/2009 |
| EP | 1416764 | A2 | 5/2004 |
| EP | 1453358 | A1 | 9/2004 |
| EP | 1453358 | A2 | 9/2004 |
| EP | 2247119 | A1 | 11/2010 |

* cited by examiner

*Primary Examiner* — Muhammad N Edun
(74) *Attorney, Agent, or Firm* — Laurence A. Greenberg; Werner H. Stemer; Ralph E. Locher

(57) ABSTRACT

A method and a device for analyzing hearing aid device settings of a first hearing aid device by a second hearing aid device. The first and the second hearing aid device each have an acousto-electric converter and an electro-acoustic converter. The method includes the step of acoustically coupling the electro-acoustic converter of the first hearing aid device to the acousto-electric converter of the second hearing aid device by a coupling device. In a further step, the acousto-electric converter of the first hearing aid device is exposed to an acoustic test signal. In one step, an acoustic output signal of the electro-acoustic converter of the first hearing aid device is detected by the acousto-electric converter of the second hearing aid device. In a further step, the detected acoustic output signal is analyzed.

10 Claims, 4 Drawing Sheets

METHOD AND DEVICE FOR ANALYZING HEARING AID SETTINGS

CROSS-REFERENCE TO RELATED APPLICATION

This application claims the priority, under 35 U.S.C. §119, of German application DE 10 2014 200 677.5, filed Jan. 16, 2014; the prior application is herewith incorporated by reference in its entirety.

BACKGROUND OF THE INVENTION

Field of the Invention

The present invention relates to a method and a device for individually setting a hearing aid device for a hearing aid wearer.

Technical advances and new scientific findings are resulting in the continuous further development of hearing aids. This relates to both the signal-processing algorithms used and the individual parameter sets for hearing aid settings calculated from the audiometric data. These further developments are taken into account numerous times in new devices.

However, due to the continuous wearing of a hearing system, a person who is hard of hearing becomes accustomed to the transmission properties and hence, for example, to the sound of the hearing system. If, for example, such a hearing aid wearer requires a new device due to a worsening of hearing, the wearer often perceives the unfamiliar sound as strange and rejects a new hearing system. Such a rejection occurs particularly with modern hearing systems since with these it is frequently possible to achieve very smooth frequency responses due to the advances in digital technology. For this reason, in the case of the provision of a new device, often the same type of hearing system already worn is used instead of a modern hearing system. This does not provide any improvement for the person who is hard of hearing and the wearer does not benefit from a further development of hearing systems.

In the event of hearing aid wearers being nevertheless prepared to use a new device, to date hearing aid acousticians have tried to match the acoustics of the old device to those of the new device by hand in order to make the changeover easier. Since modern hearing aid devices are extremely complex, it is not possible in this manner to find the optimal setting at which, on the one hand, the sound of the old device is matched and, one the other, it is still possible to benefit from the advantages of the new device.

It is known from published, European patent application EP 1453358 A1 (corresponding to U.S. Pat. No. 7,885,416), on provision with a second or subsequent hearing aid, to determine the settings of the old hearing aid device by a computer-aided process and take them into account when adjusting the new hearing aid device in a first setting. The new setting is then obtained from audiometric measurements, the data relating to the previous device and optionally further data. In this way, the sound of the new device is approximated to that of the old device.

In this case, it is necessary either to have available the data relating to the old hearing aid device or to be able to read these out of the hearing aid device in order to be able to interpret them. Alternatively, it is also possible to measure the properties of the old hearing aid device. To this end, it is also possible to use an acoustic measuring device, although this places high requirements on the acoustic environment, the source of the test signal and the acoustic measuring sensor.

SUMMARY OF THE INVENTION

Thus, the object of the present invention consists in the simplification of the setting of a hearing aid device taking into account a setting of any other hearing aid device.

The method simplifies the analysis of hearing aid device settings of a first hearing aid device in that a second hearing aid device is used to determine the properties of the first hearing aid device. Here, the first hearing aid device and the second hearing aid device each contain an acousto-electric converter and an electro-acoustic converter. The method includes the step of acoustically coupling the electro-acoustic converter of the first hearing aid device to the acousto-electric converter of the second hearing aid device by a coupling device. Here, acoustically coupled should be understood to mean that sound waves from the electro-acoustic converter of the first hearing aid device arrive at the acousto-electric converter of the second hearing aid device in a predetermined and predictable manner. This can, for example, take place through a chamber tightly enclosing the two converters. Here, it is also conceivable for the first and/or second hearing aid device to have a plurality of acousto-electric converters. In a further step, the acousto-electric converter of the first hearing aid device is exposed to an acoustic test signal and an acoustic output signal of the electro-acoustic converter of the first hearing aid device is detected by the acousto-electric converter of the second hearing aid device. The detected acoustic signal can be provided by the acousto-electric converter of the second hearing aid device, for example as an analog or digital electric signal. Finally, the detected acoustic output signal is evaluated in a step. The evaluation can, for example, take place by comparison or processing by an algorithm with the known test signal.

In an advantageous manner, the method according to the invention uses the acousto-electric converter or the microphone of the second hearing aid device as a measuring sensor thus reducing the complexity of the equipment required to perform the method.

The object is achieved with the aid of the inventive device, which is in particular configured to carry out the method. The device for analyzing a hearing aid device setting of a first hearing aid device by a second hearing aid device contains a coupling device for the acoustic coupling of an electro-acoustic converter of a first hearing aid device to an acousto-electric converter of a second hearing aid device. The coupling device is configured so that sound waves from the electro-acoustic converter of the first hearing aid device can arrive at the acousto-electric converter of the second hearing aid device in a predetermined and predictable manner. This can, for example, be achieved by a chamber enclosing both converters tightly. Here, it is also conceivable for the first and/or second hearing aid device to contain a plurality of acousto-electric converters. The device also contains an analyzer mechanism, which is configured to receive and analyze a signal with information from the acousto-electric converter from the second hearing aid device. The connection can, for example, take place by an electric signal connection, but also by electromagnetic fields or other wireless transmission techniques. The device can for example be configured to compare the signal with information from the acousto-electric converter with a known test signal or process it with an algorithm. In this case, the analyzer mechanism can be configured for connection to the second hearing aid device, for example as part of a control or also as a part or functionality of the signal processing mechanism of the second hearing aid device.

The device as claimed in the invention shares the advantages of the method as claimed in the invention.

Further advantageous embodiments are disclosed in the sub claims.

In one possible embodiment of the method as claimed in the invention, the acoustic test signal is generated by an electro-acoustic converter.

An electro-acoustic converter enables the generation of a reproducible test signal with predetermined properties in a simple manner.

In another conceivable embodiment of the method as claimed in the invention, the acoustic test signal is an ambient noise. Here, the method further contains the step of detecting the test signal by an acousto-electric reference converter.

The use of an ambient noise as the test signal makes it possible in an advantageous manner to analyze the properties of the first hearing aid device in preferred acoustic environments for the user.

In a conceivable embodiment of the method as claimed in the invention, the evaluation of the detected acoustic input signal is performed at least partially in the second hearing aid device.

The at least partial evaluation of the detected acoustic input signal in the second hearing aid device makes use in an advantageous way of the signal processing resources present in the hearing aid device and reduces the work in an external analyzer device. It would even be conceivable for the entire analysis process to be performed by the hearing aid device.

In one possible embodiment, the method for analyzing is part of a method for transferring a hearing aid device setting from a first hearing aid device to a second hearing aid device. The method for transferring also contains the step of determining a setting parameter for the second hearing aid device on the basis of the evaluation of the detected acoustic output signal. In this case, it is also possible for a plurality of or all setting parameters of the second hearing aid device to be determined. Finally, the setting parameter or parameters of the second hearing aid device are set on the basis of the setting parameter determined.

The method according to the invention for transferring a hearing aid device setting in an advantageous manner makes it possible, during the determination of the setting parameters, by the analysis of signals of the microphone of the hearing aid device also to take account of deviations of the microphone of the second hearing aid device from the ideal characteristic values and thus perform the setting with high accuracy.

In a conceivable embodiment of the method as claimed in the invention, the setting of the second hearing aid device is performed by an operator.

This makes it possible in an advantageous manner also to perform a setting as claimed in the invention of the setting parameters with a second hearing aid device, for which, for example, no suitable interface is provided for the programming in the device as claimed in the invention.

In another embodiment of the method as claimed in the invention, the setting of the second hearing aid device is performed via a signal connection to the second hearing aid device.

Thus, errors in the transmission of the setting parameters by an operator can be avoided and the setting process accelerated.

In one conceivable embodiment of the device as claimed in the invention, it contains a signal source for generating an acoustic test signal.

The signal source makes it possible in an advantageous manner to provide reproducible and predetermined acoustic signals for an analysis of the setting of the first hearing aid device.

In one possible embodiment of the device as claimed in the invention, it contains an acousto-electric reference converter for receiving the acoustic test signal.

The acousto-electric reference converter, for example a measuring microphone, enables the device to receive the test signal in a predetermined and reproducible manner and to make it available for comparison with the signal of the second hearing aid device or for combined processing. Therefore, the device as claimed in the invention is advantageously not dependent on the use of a few predetermined test signals but it is, for example, also possible to use a familiar listening environment of a hearing aid wearer for the analysis.

In one possible embodiment of the invention, it further contains a determination mechanism, which is configured to determine from a result of the analyzer mechanism a setting parameter for the second hearing aid device such that a transfer function of the second hearing aid device is approximated to a transfer function of the first hearing aid device using the setting parameter. In other words, the acoustic behavior of the second hearing device is changed such that acoustic properties that can be measured and/or perceived by a wearer are less different from the measured or perceived acoustic properties of the first hearing aid device. Ideally, it is even possible to achieve the same behavior or behavior which the wearer is no longer to differentiate.

Thus, it is possible in an advantageous manner for it to be achieved that, on a change from the first hearing aid device to the second hearing aid device, the wearer has the same auditory sensation and accepts the new device.

In one conceivable embodiment of the device, it further contains a setting mechanism, which is configured to set the setting parameter in the second hearing aid device. However, it is also possible for the setting device to be configured to change several or all setting parameters of the second hearing aid device to be changed by the setting device.

Thus, the device as claimed in the invention performs a setting of the second hearing aid device quickly and without transmission errors.

In one possible embodiment of the device as claimed in the invention, the coupling device is a passive mechanical adapter, which connects the first hearing aid device to the second hearing aid device in an acoustically defined manner. The coupling device can, for example, have the shape of a hollow body containing an inner chamber in which both the electro-acoustic converter of the first hearing aid device and the acousto-electric converter of the second hearing aid device are located or with which they are in fluid exchange. Here, the inner chamber of the coupler is preferably sealed against the environment in a substantially fluid-tight manner by walls of the coupler and the housing of the hearing aid device so that ambient sounds can only penetrate the inner chamber of the coupler with high attenuation of, for example, 40, 60, 80 or more decibels.

The coupling device enables the output signals of the first hearing aid device to be guided to the microphone or the microphones of the second hearing aid device in a simple manner so that the properties thereof can be analyzed in a reproducible and undistorted manner.

Other features which are considered as characteristic for the invention are set forth in the appended claims.

Although the invention is illustrated and described herein as embodied in a method and a device for analyzing hearing aid settings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
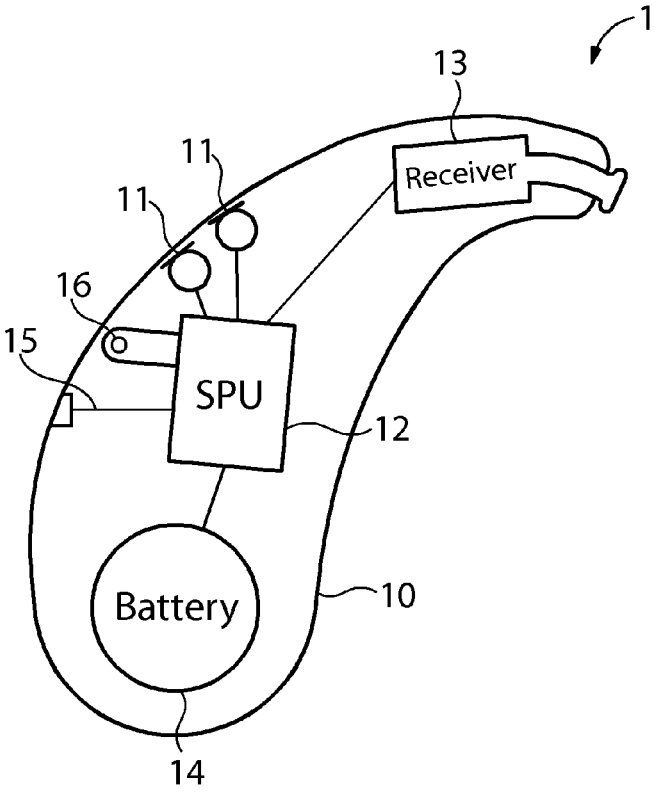
FIG. 1 is a schematic representation of a hearing aid device used in a method according the invention.

Referring now to the figures of the drawings in detail and first, particularly to FIG. 1 thereof, there is shown a schematic diagram of a hearing aid device 1 such as can be used both as a first hearing aid device 31 whose settings are to be transferred by a method to a different second hearing aid device 32 or as a second hearing aid device 32 that is to be set.

The hearing aid device 1 contains a housing 10, in which one or more microphones 11 are arranged such that they can receive sound waves from an environment of the hearing aid device 1. Also located in the housing 10 is a signal processing unit 12, which receives the sound waves converted into electric signals by the microphones 11 for further processing. The processing by the signal processing unit 12 is, for example, the normal function in hearing aid devices, such as frequency-dependent amplification. However, more complex signal processing functions such as the establishment of direction effects with signals from a plurality of microphones or filtering of interference noise are also conceivable. In the case of a binaural hearing aid system, binaural signal processing is also conceivable.

Also located in the housing 10 is a receiver 13, which receives the electric signal processed by the signal processing unit or mechanism 12 and converts it into acoustic sound waves which are output into the environment outside the housing 10. Power is supplied by a battery or an accumulator 14, which is also arranged in the housing 10.

Figure 3:
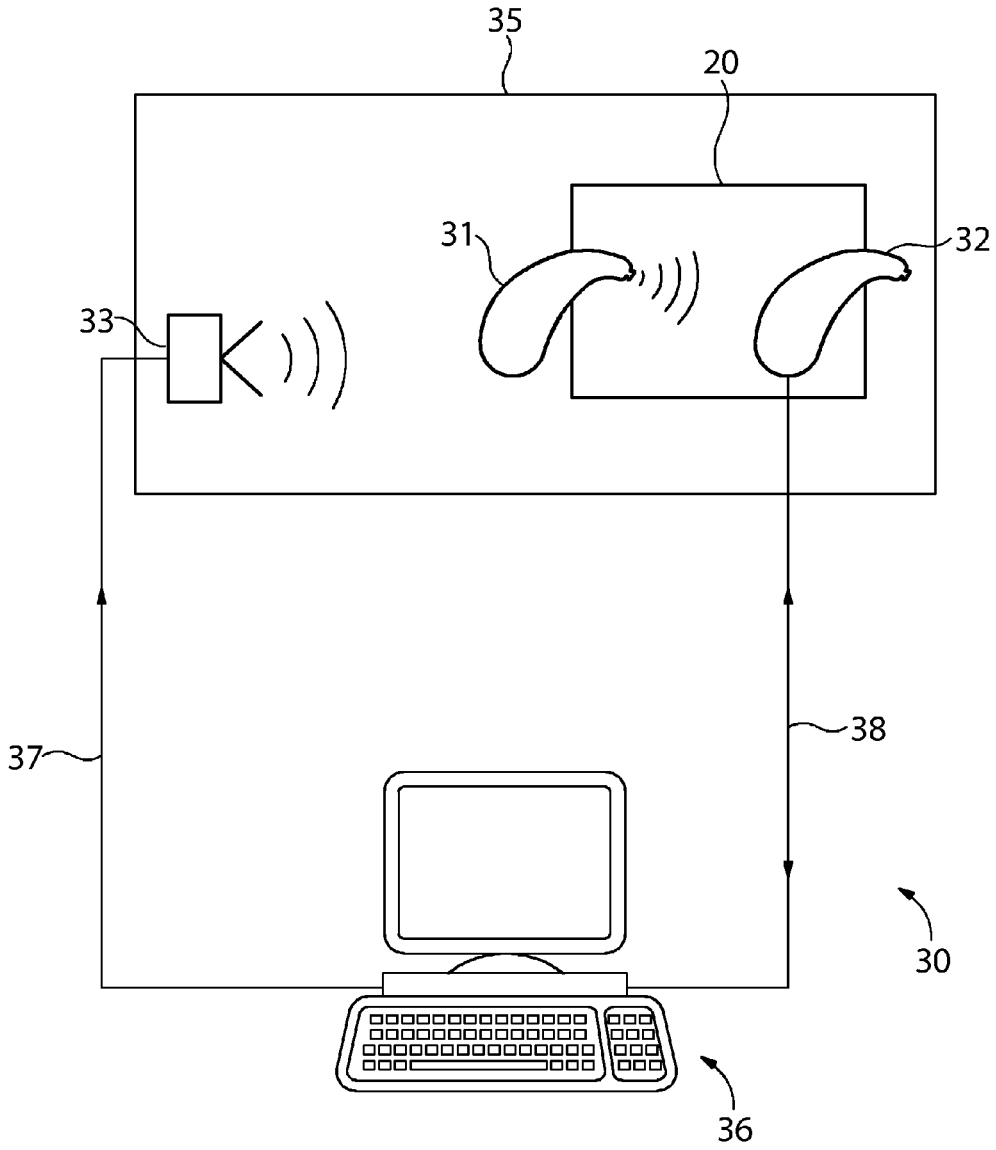
FIG. 3 is a schematic representation of a set up for carrying out the method.
Figure 4:
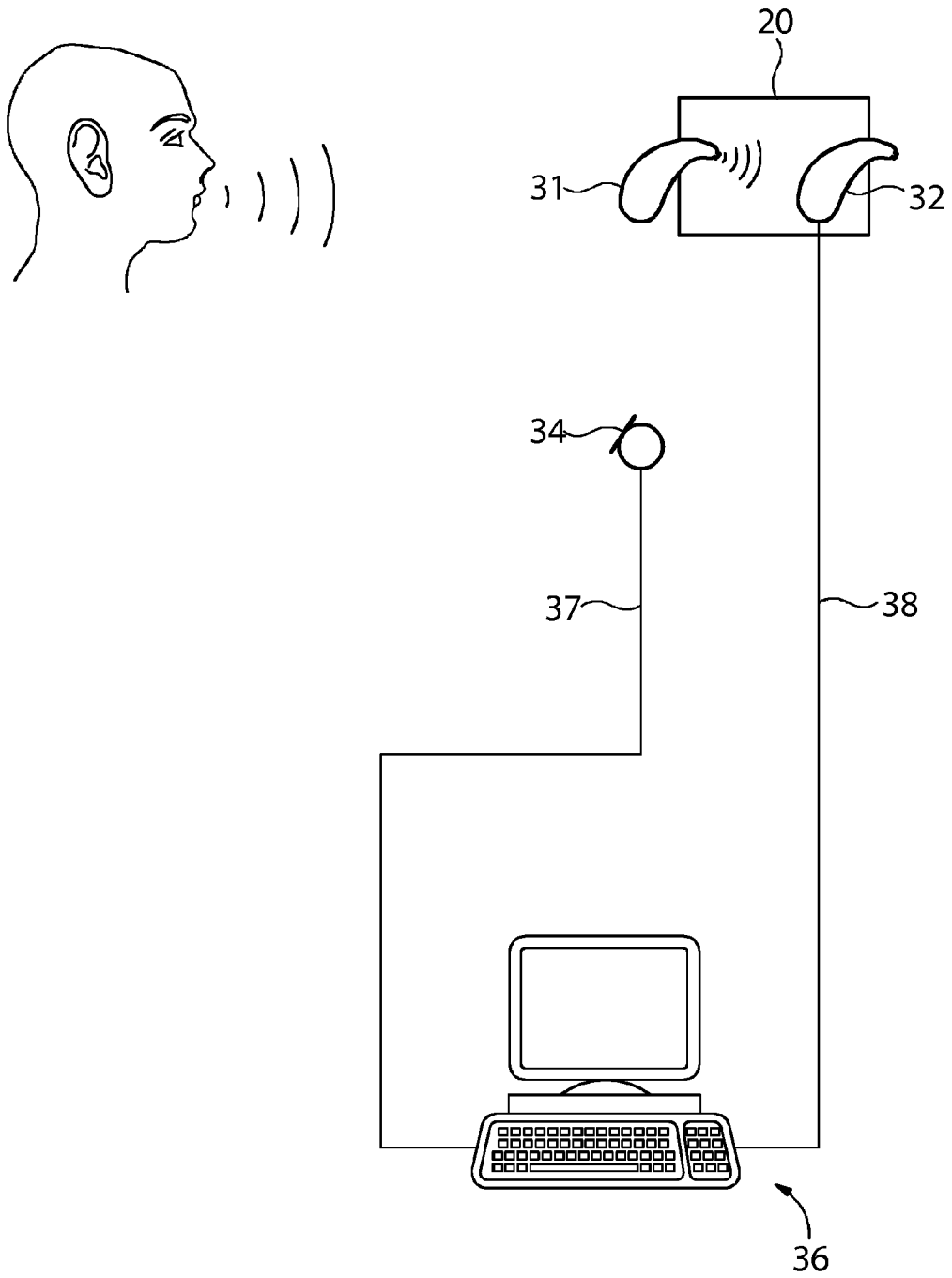
FIG. 4 is a schematic representation of a set up for carrying out the method.

In addition, at least the second hearing aid device 32 also contains an interface 15 via which it can establish a signal connection 38 with a controller 36, see FIGS. 3 and 4. The interface 15 enables the hearing aid device 31, 32 to send sound waves received via the microphone 11 as analog or digital acoustic signals or as signals derived therefrom to the controller 36.

FIG. 1 and FIGS. 2 to 4 each show a behind-the-ear hearing aid device as a hearing aid device 1, 31, 32. However, with a suitable coupling device 20, the method according to the invention can also be used for an in-the-ear, in-the-canal, receiver-in-the-canal or another kind of hearing aid device. Here, it is also conceivable for the method for transmitting settings from a behind-the-ear hearing aid device to an in-the-ear hearing aid device to be used. The only thing that is absolutely necessary is that the first hearing aid device 31 contains a receiver 13 and the second hearing aid device 32 contains a microphone 11. For example, the acoustic signal could also reach the first hearing aid device 31 from the control 36 via an induction coil 16.

Figure 2:
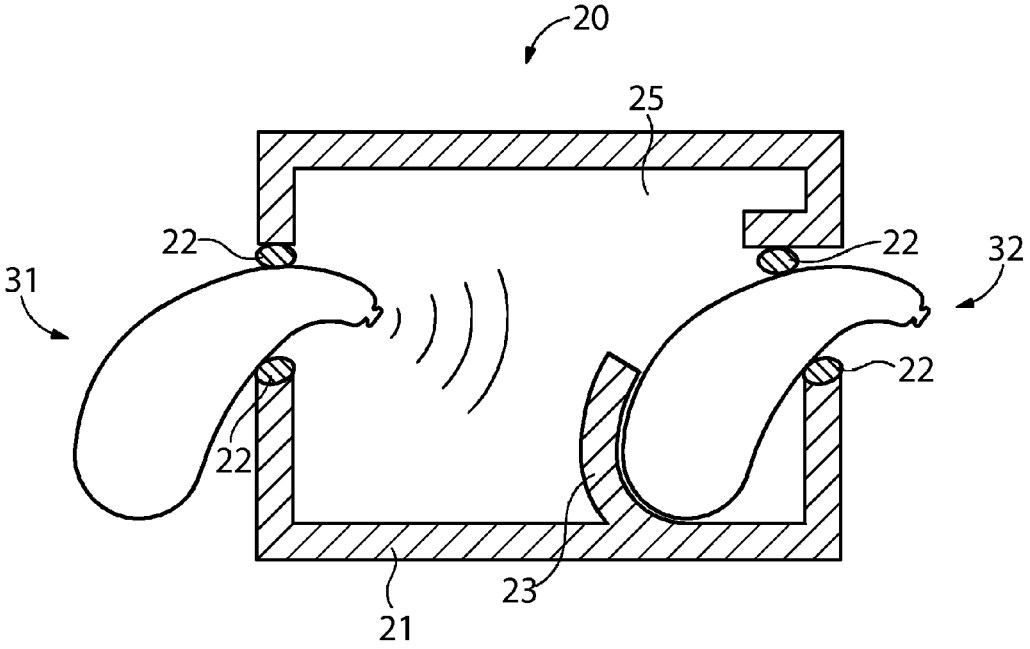
FIG. 2 is a schematic representation of an acoustic coupling of a first and a second hearing aid device for the performance of the method according to the invention.

FIG. 2 is a schematic diagram of an acoustic coupling as claimed in the invention of the first hearing aid device 31 and the second hearing aid device 32 for performing the method as claimed in the invention. The representation is not true to scale.

In one embodiment, the coupling device 20 is embodied as a shoe or tube that at least partially accepts the first hearing aid device 31 and the second hearing aid device 32. In one arrangement as claimed in the invention of the first hearing aid device 31 and of the second hearing aid device 32, at least the opening, via which the first hearing aid device 31 emits the sound generated by the receiver 13 into the environment, is located in a inner chamber 25 of the coupling device 20. On the other hand, the microphone or microphones 11 or an opening in the housing 10, via which the sound waves from the environment can reach the microphone 11 of the first hearing aid device 31, is/are located outside the coupling device 20.

In exactly the opposite way, it is the second hearing aid device 32, whose microphone or microphones 11 is/are in fluid connection with the inner chamber 25 and are able to receive sound waves from the inner chamber 25. On the other hand, the receiver 11 of the second hearing aid device is not in fluid connection with the inner chamber 25 so that the microphone or microphones 11 of the second hearing aid device 32 are substantially acoustically isolated from its receiver 13 apart from possible sound conduction by the hearing aid device itself.

It is also conceivable for the receiver 11 of the second hearing aid device 32 to be acoustically isolated from the microphone or microphones 11 of the first hearing aid device 31. To this end, it would be conceivable for a sealed chamber or a terminal for the housing 11 that ensures acoustic decoupling to be embodied on the coupling device 20.

Arranged between the coupling device 20 and the housing 10 of the first hearing aid device 31 and the second hearing aid device 32 on the common boundary to the environment is a seal 22 which ensures that the inner chamber 25 of the coupling device 20 is separated from the environment in a fluid-tight manner or acoustically by its outer wall, the seal 22 and the housing 10. However, if the coupling device 20 itself is made of an elastic material, the seal 22 can also be dispensed with.

The coupling device 20 can, for example, be made of two half-shells 21 that can be separated in order to insert the hearing aid device 31, 32. A seal can again be provided at the separating line between the half-shells 21. The half-shells 21 can be embodied separately and held together by a holding device, for example a clip fastener, an outer frame, an elastic shackle or simply by only a rubber band. However, it is also conceivable for the two half-shells to be connected by a joint or hinge. In their interior, the half-shells 21 preferably provide structures 23, which are suitable for fixing the position of the first and/or second hearing aid device 31, 32 relative to the coupling device 20.

However, the coupling device 20 can also be made of an elastic material in the form of a tube or sleeve so that the first hearing aid device 31 is introduced from one end and the second hearing aid device from the opposite end. Here, the seal 25 preferably copies the outer contours of the hearing aid device so that, after introduction, the hearing aid devices are positioned relative to one another in a predetermined arrangement and the sealing effect between the inner chamber 25 and the environment is achieved.

Preferably, the inner chamber 25 has damping properties so that the acoustic coupling between the first hearing aid device 31 and the second hearing aid device 32 has as little resonance as possible or no resonance at all and a transmission function is approximately linear. In one embodiment, damping properties can be achieved by a soft and porous material, which is possibly on the side facing the inner chamber. However, ridges or other superficial structures, which reflect diffusely and prevent the formation of resonance, are also conceivable.

Here, in one conceivable embodiment, a volume of the inner chamber 25 is comparable to a volume between the receiver 13 of the first hearing aid device 32 and an eardrum in an auditory canal of a wearer so that the acoustic properties of the receiver can be simulated in the auditory canal. The volume of the inner chamber can be, for example, 1 $cm^3$, 0.5 $cm^3$ or 0.25 $cm^3$. The distance between the first hearing aid device 31 and the second hearing aid device can be, for example, 10 mm, 5 mm or 3 mm.

FIG. 3 shows a conceivable system 30 for carrying out the method as claimed in the invention. The system 30 contains the controller 36, which is configured to output a test signal via a first signal connection 37 and receive results via a second signal connection 38 with the second hearing aid device 32 and also to make settings on the second hearing aid device.

In one conceivable embodiment, the first hearing aid device 31 and the second hearing aid device 32, which as explained with respect to FIG. 2, are acoustically coupled to one another via the coupling device 20, are arranged in a test chamber 35. Also located in the test chamber 35 is a sound source 33, which, controlled by the controller 36, outputs a test signal acoustically via the signal connection 37. The signal connection 37 can be an analog electric line connected to a DA converter of the control device. However, also conceivable are digital connections for audio signal transmission such as TOS-LINK, HDMI, USB or wireless measure such as Bluetooth. In the field of audiology, HI-PRO is also used as a programming interface.

The test chamber 35 is configured to reduce external interference noise and enable propagation of the test signal in its interior that is as frequency-neutral as possible. A test chamber of this kind can be an acoustically dead chamber or also a small measuring box, which substantially only provides space for the hearing aid device 31, 32, the coupling device 20 and the sound source 33. However, in a suitable environment without interference noise, it is also possible to dispense with the test chamber 35.

FIG. 4 shows another possible system 30 for carrying out the method as claimed in the invention. The substantial difference from FIG. 3 is that, instead of the sound source 33 controlled by the controller 36, there is another possibly natural sound source. Here, a speaker is shown symbolically as representative of natural noise from the environment of a person wearing a hearing aid device.

Since the signal of the sound source is unknown to the controller, for the analysis of the signals received by the second hearing aid device 32, it is necessary to detect the sound source exactly. To this end, in this embodiment, a microphone 34 with predetermined known properties is provided, which receives the signal from the sound source in parallel to the first hearing aid device 31.

As explained with respect to FIG. 3, it is also possible for the device in FIG. 4 to be located in a test chamber 35. However, it is also conceivable, in particular when the controller 36 is a portable device such as a portable computer, to carry out the method according to the invention in the familiar listening environment of the person wearing the hearing aid device.

Figure 5:
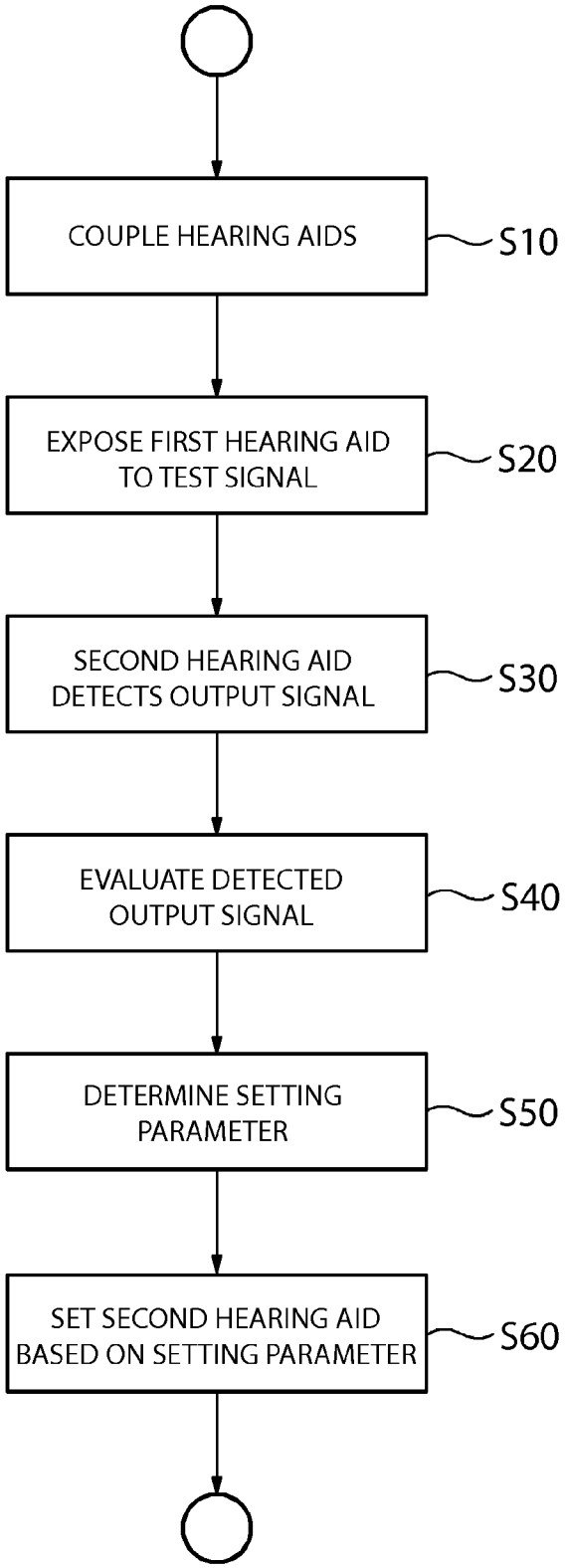
FIG. 5 is a flow chart showing an execution of the method.

FIG. 5 is a schematic flow diagram of a possible embodiment of the method as claimed in the invention.

In step S10, the electro-acoustic converter of the first hearing aid device 31 is acoustically coupled to the acousto-electric converter 32 of the second hearing aid device by the coupling device 20, as described with respect to FIG. 2. Here, the microphones 11 are the acousto-electric converters and the receivers 13 are the electro-acoustic converters.

In step S20, the acousto-electric converter of the first hearing aid device 13 is exposed to an acoustic test signal. The microphone 11 of the first hearing aid device 31 converts the sound waves into an electric signal, which is amplified and filtered by the signal processing mechanism 12 in a frequency-dependent manner in accordance with the settings of the first hearing aid device 31. The resulting electric signal is converted by the receiver 13 into a sound wave and output into the inner chamber 25 of the coupling device 20.

In step S30, the acoustic output signal of the electro-acoustic converter or the receiver 13 of the first hearing aid device 31 is detected by the acousto-electric converter or the microphone 11 of the second hearing aid device 32.

In step S40, the detected acoustic output signal is evaluated.

In one embodiment, the evaluation can take place in the controller 36, which contains the analyzer mechanism as a sub-unit or provides the functionality of the analyzer mechanism. To this end, the detected output signal is transmitted as an analog or, following A/D conversion, digital signal via the signal connection 38. As already explained with respect to the signal connection 37, a plurality of signal connection methods can be used here. The evaluation is performed in the controller 36 in that the test signal is compared with the detected output signal. This can, for example, be a comparison of the levels in different frequency bands according to a Fourier transformation in order to determine the frequency-dependent amplification. It is also conceivable for time-dependent control constants that can be determined by quickly-changing test signals to be detected.

Here, the test signal can either be generated as in FIG. 3 by the controller 36 and therefore known or, as in FIG. 4, detected in parallel to the output signal.

It is also conceivable for the signal processing unit 12 of the second hearing aid device 32 to be configured to carry out the analysis itself or at least in partial steps. Thus, it is, for example, conceivable for the signal processing unit 12 to carry out a Fourier transformation and to notify the controller 36 of the amplitudes in the individual frequency bands. To this end, the signal processing unit 12 contains the analyzer mechanism as sub-unit or provides the functionality of the analyzer mechanism.

In one possible embodiment of the method as claimed in the invention, it further contains the step S50 of determining a setting parameter for the second hearing aid device on the basis of the evaluation of the detected acoustic output signal. For example, the controller 36 can determine from the frequency-dependent amplitudes a parameter set for frequency-dependent amplification for the second hearing aid device 32, with which it generates the desired output characteristic at a constant input amplitude, for example by standardizing the frequency-dependent amplitudes of the detected output signal with frequency-dependent amplitudes of the input signal.

In one conceivable embodiment of the method as claimed in the invention, a step S60 of setting the second hearing aid device on the basis of the setting parameter determined is provided. Here, it is conceivable for the controller 36 to perform a setting of the hearing aid device via the signal line 38. This is particularly simple if the controller 36 is a device for fitting which is also usually provided for setting hearing aid devices. This can, for example, be provided with an HI-PRO interface.

However, it is also conceivable for the setting of the parameters on the second hearing aid device to be performed manually by an operator, if, for example, the second hearing aid device does not have any programmable interface, or no compatible programming interface.

Although the invention was illustrated and described in detail by the preferred exemplary embodiment, the invention is not restricted by the disclosed examples and other variations can be derived herefrom by the person skilled in the art without departing from the scope of protection of the invention.

The invention claimed is:

1. A method for transferring a hearing aid device setting from a first hearing aid device to a second hearing aid device, wherein the first hearing aid device and the second hearing aid device each include an acousto-electric converter and an electro-acoustic converter, which comprises the steps of:

acoustically coupling the electro-acoustic converter of the first hearing aid device to the acousto-electric converter of the second hearing aid device by means of a coupling device;

exposing the acousto-electric converter of the first hearing aid device to an acoustic test signal;

detecting an acoustic output signal of the electro-acoustic converter of the first hearing aid device by means of the acousto-electric converter of the second hearing aid device; and evaluating a detected acoustic output signal;

determining a setting parameter for the second hearing aid device based on the evaluation of the detected acoustic output signal, wherein the setting parameter is determined such that a transfer function of the second hearing aid device is approximated to the transfer function of the first hearing aid using the setting parameter; and setting the second hearing aid device based on the determined setting parameter.

2. The method according to claim 1, which further comprises generating the acoustic test signal by a further electro-acoustic converter.

3. The method according to claim 1, wherein the acoustic test signal is an ambient noise and the method further comprises the step of detecting the acoustic test signal by means of an acousto-electric reference converter.

4. The method according to claim 1, which further comprises performing the evaluating of the detected acoustic output signal at least partially in the second hearing aid device.

5. The method according to claim 1, which further comprises performing the setting of the second hearing aid device by an operator.

6. The method according to claim 1, which further comprises performing the setting of the second hearing aid device via a signal connection to the second hearing aid device.

7. A device for transferring a hearing aid device setting from a first hearing aid device to a second hearing aid device, the device comprising:

a coupler for acoustically coupling of an electro-acoustic converter of the first hearing aid device to an acousto-electric converter of the second hearing aid device; and an analyzer receiving and analyzing a signal with information from the acousto-electric converter from the second hearing aid device;

a determination mechanism configured to determine a setting parameter for the second hearing aid device from a result of the analyzer device, such that a transfer function of the second hearing aid device is approximated to the transfer function of the first hearing aid device using the setting parameter, and a setting mechanism configured to set the setting parameter in the second hearing aid device.

8. The device according to claim 7, further comprising a signal source for generating an acoustic test signal.

9. The device according to claim 7, further comprising an acousto-electric reference converter for receiving an acoustic test signal.

10. The device according to claim 7, wherein said coupler is a passive mechanical adapter connecting the first hearing aid device to the second hearing aid device in an acoustically defined manner.

* * * * *